US006247559B1

(12) United States Patent
Ach

(10) Patent No.: US 6,247,559 B1
(45) Date of Patent: Jun. 19, 2001

(54) ELEVATOR WITH MACHINE ROOM BELOW

(75) Inventor: Ernst Ach, Ebikon (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/430,846

(22) Filed: Nov. 1, 1999

(30) Foreign Application Priority Data

Nov. 2, 1998 (EP) ..... 98811093

(51) Int. Cl.[7] ..... B66B 1/00
(52) U.S. Cl. ..... 187/414; 187/272
(58) Field of Search ..... 187/414, 250, 187/251, 263, 272, 275

(56) References Cited

U.S. PATENT DOCUMENTS 6,039,152 * 3/2000 Schops et al. ..... 187/414

FOREIGN PATENT DOCUMENTS 297 10 732 U 9/1997 (DE) .
298 06 526 U 9/1998 (DE) .
0 415 218 11/1993 (EP) ..... 187/266
1-321280 * 12/1989 (JP) ..... 187/262
09002762 1/1997 (JP) .

* cited by examiner

*Primary Examiner*—Eileen D. Lillis
*Assistant Examiner*—Thuy V. Tran
(74) *Attorney, Agent, or Firm*—MacMillan, Sobanski & Todd, LLC

(57) ABSTRACT

At a hoistway door on the side of an entrance area there is provided a movable sill that can be moved to uncover an opening that affords access to a machine room lying below the entrance area. The machine room is accessible not only from the access opening, but also from a hoistway pit of the elevator hoistway. When the elevator car is stuck at the lowest floor, emergency operation functions can be carried out through the uncovered access opening. The necessary operating elements of a drive device in the machine room are arranged in such a manner that they can be operated manually through the access opening.

11 Claims, 2 Drawing Sheets

ELEVATOR WITH MACHINE ROOM BELOW

BACKGROUND OF THE INVENTION

The present invention relates generally to an elevator with an elevator car that can travel in an elevator hoistway between a hoistway overhead and a hoistway pit and, in particular, to an elevator having a machine room below an entrance area of a landing door of the elevator hoistway nearest to the hoistway pit with an entrance for maintenance work on the drive equipment needed for operation of the elevator.

The European patent specification EP 0 415 218 shows an elevator with a machine room located below. The drive machine and the control are in a room at the side of the elevator hoistway below the lowest floor, being positioned in the room on the same side as its door. The room is closed on its upper side by a cover. With the cover open, the room is accessible from above.

A disadvantage of this known arrangement is that the room, which is accessible only from above, and which is occupied by the drive machine, control panel, traction sheave, and control cabinet, affords practically no free space for maintenance staff to stand. Moreover, there is the danger that during maintenance work items of clothing can be caught by rotating parts. Another disadvantage is that walking over the cover in the area of the entrance of the elevator door causes structure-borne noise that can be heard at a great distance. Furthermore, dirt gathers in the area of the edge of the cover and falls into the machine room each time the cover is opened.

SUMMARY OF THE INVENTION

It is an object of the present invention to avoid the disadvantages of the known arrangement and to make a machine room that is located below readily accessible.

In essence, the advantages resulting from the present invention relate to the fact that the entrance to the machine room is not visible from outside and no special building measures such as penetration of the floor, a frame for the cover, fastenings to the floor slab on the cover frame, sound insulation measures, etc. are necessary. This notwithstanding, even when the elevator car is stuck at the lowest floor, the machine room is accessible. Emergency operation functions can be carried out readily in all cases. Furthermore, under normal circumstances the hoistway pit can be used for access to the machine room.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
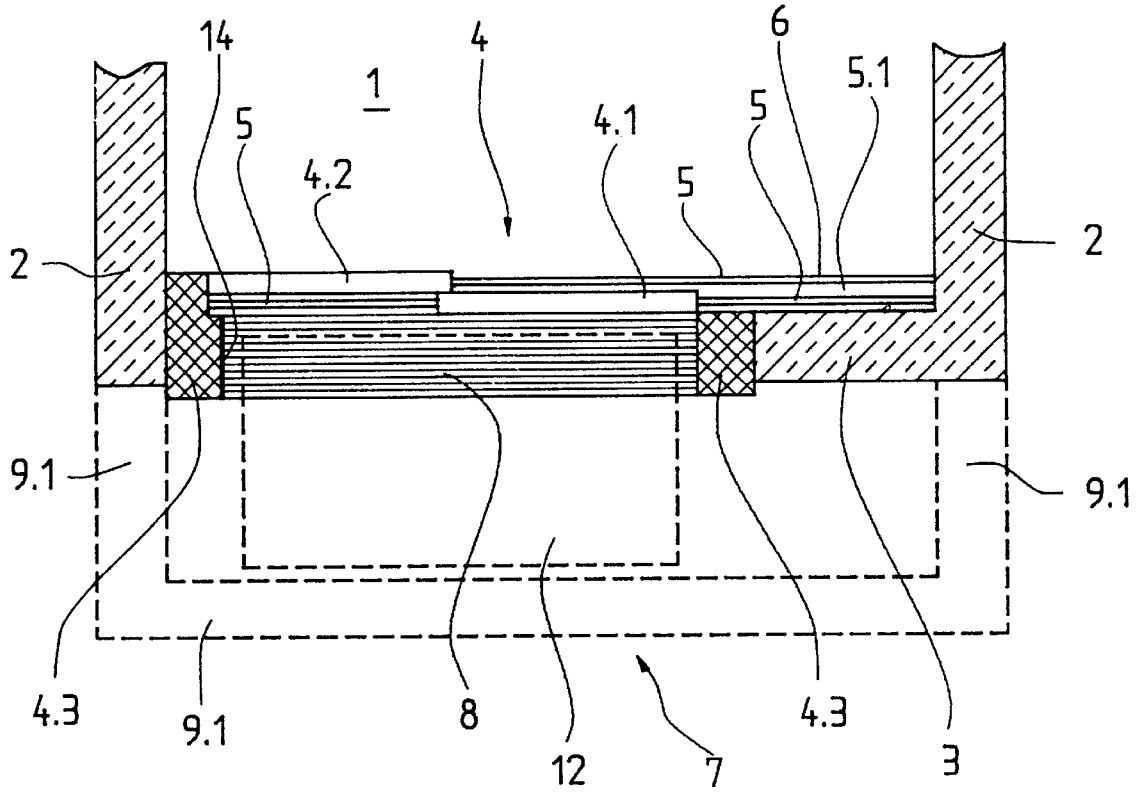
FIG. 1 is a cross-sectional plan view taken through an entrance area of the lowest floor of an elevator installation in accordance with the present invention.
Figure 2:
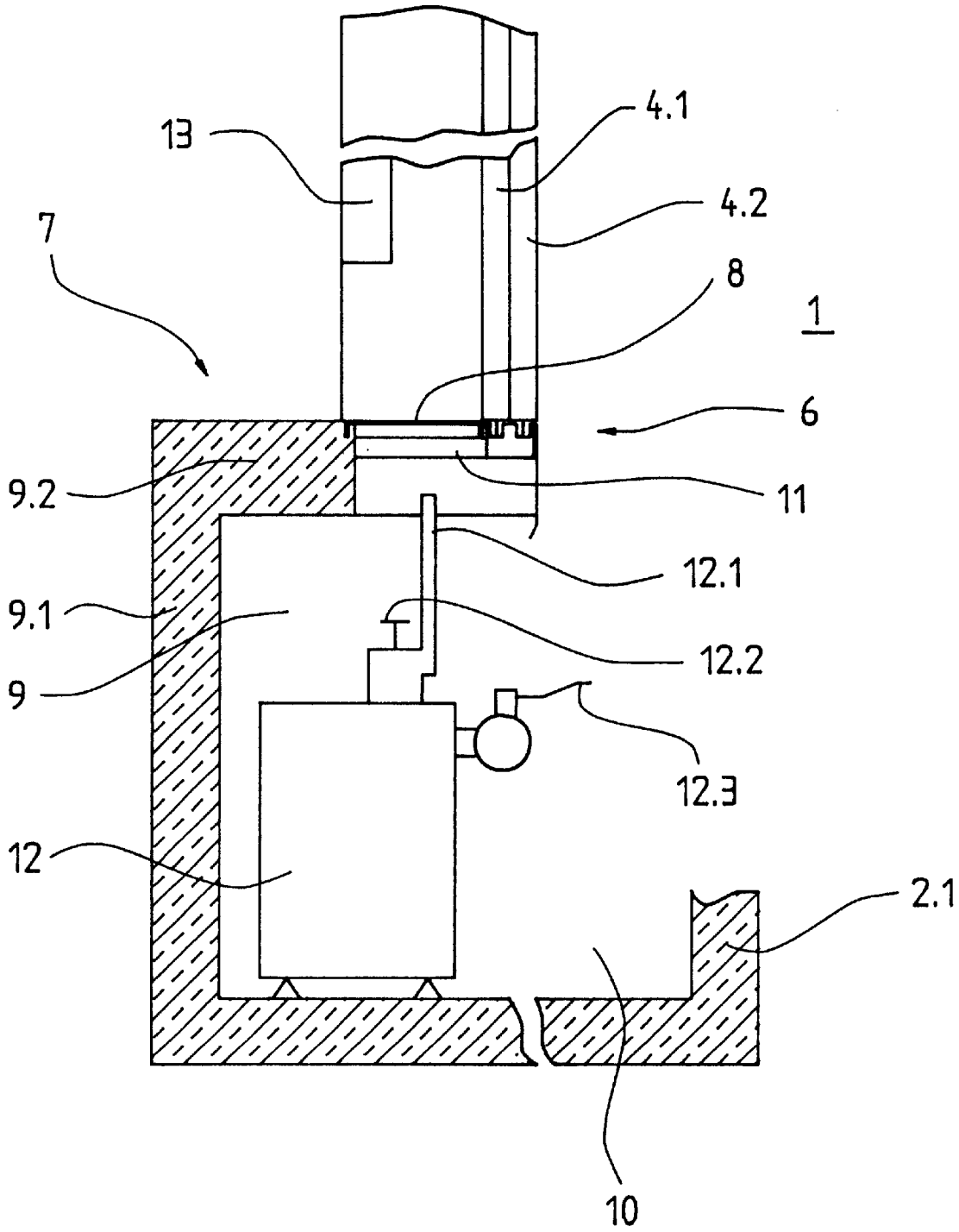
FIG. 2 is cross-sectional elevation view of the entrance area shown in the FIG. 1.

There is shown in the FIGS. 1 and 2 an elevator hoistway 1 that is closed by hoistway side walls 2 and a hoistway back wall 2.1. A hoistway wall 3 on the front side has a door opening for a hoistway door 4 which consists, for example, of architrave elements 4.3 at the sides, a first telescopic panel 4.1, and a second telescopic panel 4.2. The telescopic panels 4.1 and 4.2 are guided in first grooves 5 of a fixed sill 6. At the side of an entrance area 7, a movable sill 8 is provided for emergency operation of the elevator. When the sill 8 is open, an access opening 11 provides access to a machine room 9 lying below the entrance area 7, the machine room being closed by means of machine room walls 9.1 and a ceiling 9.2 formed by a floor of the building. The machine room 9 is not only accessible from the opening 11, but also from a hoistway pit 10 of the elevator hoistway 1. Entry to the hoistway pit 10 takes place from the hoistway door 4 nearest to the hoistway pit 10.

When maintenance work takes place, the elevator car is parked at least one floor above the lowest floor. The maintenance staff then has free access to the hoistway pit 10 through the lowest landing door 4. The machine room 9, which opens onto the hoistway pit 10, is easily accessible from the hoistway pit for maintenance work. If the elevator car is stuck at the lowest floor, emergency operating functions such as, for example, operating an evacuation device, switching on the hoistway lighting, releasing the brake on a rope traction elevator, or actuation of valves and/or a hand pump on a hydraulic elevator, can be carried out through the access opening 11. The operating elements of a drive device 12 of a rope traction elevator or hydraulic elevator that are needed for this purpose are arranged in such a manner that they can be manually operated through the opening 11. FIG. 2 shows a hydraulic power unit of a hydraulic elevator with the following operating elements: a hand pump 12.1, an emergency lowering valve 12.2, and a shutoff valve 12.3. The shutoff valve 12.3 is shown in the closed position. Not shown are the oil tank lock and the oil level indicator. The operating elements mentioned are accessible, and can be operated and/or inspected, from the access opening 11 as well as from the hoistway pit 10.

To control the elevator a control device 13 is provided which is positioned, for example, on the architrave element 4.3, thereby ensuring accessibility from outside the hoistway 1.

Figure 3:
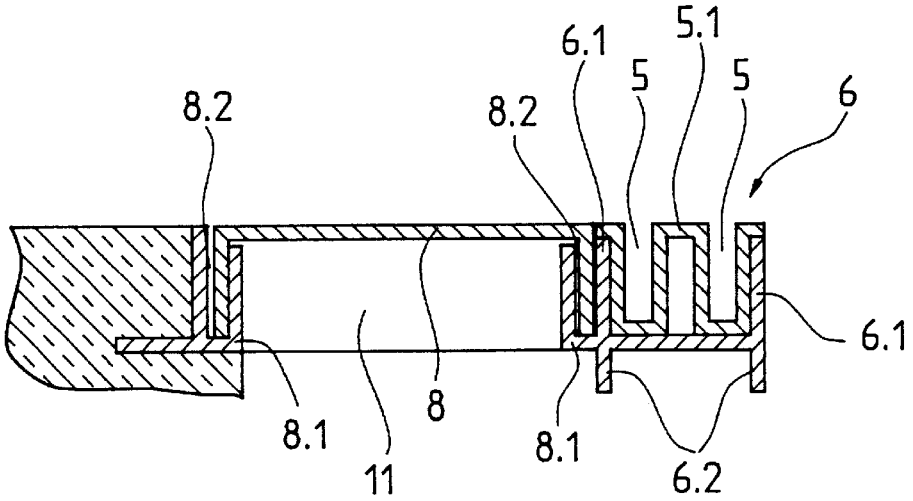
FIG. 3 is a fragmentary cross-sectional elevation view of the doorsill in the entrance area shown in the FIG. 1.

FIG. 3 shows details of the fixed door sill 6 and the movable door sill 8. The fixed door sill 6 has an H-shaped cross section, there being between upper legs 6.1 of the "H" a guiding element 5.1 that forms the first grooves 5. Lower legs 6.2 of the "H" as well as the upper legs 6.1 of the "H" serve as reinforcement of the fixed sill 6. The movable sill 8 is carried by a frame 8.1, which is positioned at one end on the building structure and at the other end on the fixed sill 6. The frame 8.1 has a second, surrounding groove 8.2, which serves as a mounting for the movable sill 8 and protects the machine room 9 against penetrating water and dirt. The movable sill 8 can be hinged upwards against the architrave element 4.3 or lifted out of the frame 8.1. A hinge 14 is shown in the FIG. 1 connected between the sill 8 and the entrance area 7 such as at the base of the adjacent architrave element 4.3. Not shown is a bolt mounted on the movable sill 8 and/or a lock mounted on the movable sill 8, which prevent the operating elements from being actuated by unauthorized persons.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator structure comprising:

an elevator hoistway for travel of an elevator car and having a pair of side walls extending between a back wall and a front wall;

a hoistway pit at a bottom end of said hoistway, said hoistway pit being formed by lower ends of said side walls and a lower end of said back wall, said hoistway pit being open at a front;

a landing door in a door opening in said front wall at a floor adjacent an upper end of said hoistway pit, said landing door being adjacent an entrance area of said floor outside said hoistway front wall to permit passengers to move between an elevator car in said hoistway and said entrance area;

an access means in said entrance area of said floor adjacent said door opening;

a machine room located below said entrance area and being accessible from said hoistway pit and through said access means, said machine room being formed by machine room walls extending from said lower ends of said side walls and being closed by a ceiling formed by said floor, said machine room being open to said open front of said hoistway pit; and an elevator drive equipment positioned in said machine room whereby said elevator drive equipment is accessible for maintenance work by a person entering said machine room both from said open front of said hoistway pit and through said access means.

2. The elevator structure according to claim 1 wherein said access means includes an access opening formed in said entrance area of said floor and a movable sill positioned in said access opening.

3. The elevator structure according to claim 2 wherein said movable sill is removable by lifting from said access opening.

4. The elevator structure according to claim 2 including a frame mounted in said access opening and having a groove for removably retaining said movable sill.

5. The elevator structure according to claim 2 including a frame mounted in said access opening for removably retaining said movable sill, said frame having one side attached to said floor and an opposite side attached to a fixed sill in said door opening.

6. The elevator structure according to claim 2 including a hinge attaching said movable sill to said entrance area of said floor in said access opening and said movable sill is removable by swiveling about said hinge.

7. The elevator structure according to claim 1 wherein said drive device includes operating elements positioned adjacent to said access opening for manual operation through said access opening.

8. The elevator structure according to claim 7 wherein said drive device is a hydraulic drive unit and said operating elements include a hand pump.

9. The elevator structure according to claim 7 wherein said drive device is a hydraulic drive unit and said operating elements include an emergency lowering valve.

10. The elevator structure according to claim 7 wherein said drive device is a hydraulic drive unit and said operating elements include a shutoff valve.

11. In an elevator structure including an elevator hoistway for travel of an elevator car and having a pair of side walls extending between a back wall and a front wall, a hoistway pit at a bottom end of the hoistway, a landing door in a door opening in the front wall at a floor adjacent an upper end of the hoistway pit, the landing door being adjacent an entrance area of the floor outside the hoistway front wall to permit passengers to move between an elevator car in the hoistway and the entrance area, a machine room located below the entrance area and being accessible from the hoistway pit, and an elevator drive equipment positioned in the machine room, an access apparatus comprising:

an access opening formed in the entrance area of the floor adjacent the door opening in the front wall;

a movable sill removably retained in said access opening whereby the elevator drive equipment is accessible for maintenance work both from the hoistway pit and through said access opening; and a frame mounted in said access opening and having a surrounding groove for removably retaining said movable sill, said groove opening upwardly to prevent water and dirt in the entrance area from entering the machine room through said access opening.

* * * * *